US008430483B2

(12) United States Patent
Yamashita

(10) Patent No.: US 8,430,483 B2
(45) Date of Patent: Apr. 30, 2013

(54) LIQUID DISCHARGE DEVICE AND MANUFACTURING METHOD THEREOF

(75) Inventor: Toru Yamashita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 420 days.

(21) Appl. No.: 12/749,431

(22) Filed: Mar. 29, 2010

(65) Prior Publication Data

US 2010/0245482 A1 Sep. 30, 2010

(30) Foreign Application Priority Data

Mar. 30, 2009 (JP) ..... 2009-081990

(51) Int. Cl.
*B41J 2/14* (2006.01)
*B41J 2/16* (2006.01)

(52) U.S. Cl.
USPC ..... 347/50

(58) Field of Classification Search ..... None
See application file for complete search history.

(56) References Cited

U.S. PATENT DOCUMENTS

| | | | | |
|---|---|---|---|---|
| 5,896,150 | A | 4/1999 | Kobayashi et al. | |
| 6,309,057 | B1 | 10/2001 | Kobayashi et al. | |
| 7,237,876 | B2 * | 7/2007 | Hirota | 347/68 |
| 7,351,649 | B2 * | 4/2008 | Shinkai | 438/612 |
| 7,374,277 | B2 * | 5/2008 | Nakayama | 347/68 |
| 7,871,152 | B2 * | 1/2011 | Suzuki et al. | 347/50 |
| 2002/0038898 | A1 | 4/2002 | Sugiyama et al. | |
| 2004/0119787 | A1 | 6/2004 | Mori | |
| 2005/0239233 | A1 | 10/2005 | Shinkai | |
| 2006/0226200 | A1 | 10/2006 | Banno et al. | |
| 2008/0211873 | A1 * | 9/2008 | Ito | 347/50 |
| 2009/0309931 | A1 * | 12/2009 | Miura et al. | 347/55 |

FOREIGN PATENT DOCUMENTS

| | | | |
|---|---|---|---|
| JP | S62-124955 | A | 6/1987 |
| JP | H07-096605 | A | 4/1995 |
| JP | H11-040612 | A | 2/1999 |
| JP | 2002-110832 | A | 4/2002 |
| JP | 2004-209967 | A | 7/2004 |
| JP | 2004-291529 | A | 10/2004 |
| JP | 2005-305847 | A | 11/2005 |
| JP | 2006-278964 | A | 10/2006 |
| JP | 2007-050552 | A | 3/2007 |
| JP | 2007-290234 | A | 11/2007 |
| JP | 2007-324211 | A | 12/2007 |
| JP | 2008-183880 | A | 8/2008 |

OTHER PUBLICATIONS

Japan Patent Office, Office Action for Japanese Patent Application No. 2009-081990, mailed Aug. 16, 2011.

* cited by examiner

*Primary Examiner* — Matthew Luu
*Assistant Examiner* — Renee I Wilson
(74) *Attorney, Agent, or Firm* — Baker Botts L.L.P.

(57) ABSTRACT

A bump is disposed on a surface of an actuator unit and communicated with a corresponding electrode of the actuator unit, and a part of the bump is extended through an insulating covering material to be electrically connected to a corresponding terminal of a wiring board. When a point which is positioned on an outer circumferential surface of a base end portion of the bump, and is closest to a drive part is assumed to be a closest point, and a point which is positioned on the outer circumferential surface of the base end portion of the bump, and is most distant from the drive part is assumed to be a most distant point, a close region including the closest point is processed such that the uncured insulating covering material is less likely to flow in the close region than in a distant region including the most distant point.

9 Claims, 8 Drawing Sheets

LIQUID DISCHARGE DEVICE AND MANUFACTURING METHOD THEREOF

CROSS-REFERENCE TO RELATED APPLICATIONS

This Nonprovisional application claims priority under 35 U.S.C. §119(a) on Patent Application No. 2009-81990 filed in Japan on Mar. 30, 2009, the entire contents of which are hereby incorporated by reference.

BACKGROUND

The present invention relates to a liquid discharge device constituted by physically and electrically connecting a drive unit for selectively discharging liquid from a plurality of nozzles and a wiring board for applying a drive voltage to the drive unit to each other, and a manufacturing method thereof.

As a liquid discharge device for discharging liquid from a nozzle, for example, an ink discharge device is well known, and one example thereof is disclosed in Japanese Patent Application Laid-Open No. 2005-305847. The ink discharge device of Japanese Patent Application Laid-Open No. 2005-305847 includes an actuator unit having a plurality of drive parts for selectively discharging an ink from a plurality of nozzles on the basis of a drive voltage, and a wiring board having a sheet-like board main body and a plurality of wirings formed on the surface of the board main body. In addition, on the surface of the actuator unit, a plurality of electrodes in correspondence to the plurality of individual drive parts are formed. Terminals are formed on end portions of the plurality of individual wirings on the wiring board, and the plurality of wirings and the plurality of terminals are covered with a synthetic resin layer formed on the surface of the board main body. Further, the plurality of terminals on the wiring board and the plurality of electrodes on the actuator unit are electrically connected to each other via a plurality of bumps formed on the surface of the actuator unit. The plurality of individual bumps are extended through the uncured synthetic resin layer during the manufacturing process to be electrically connected to the terminals, and the actuator unit and the wiring board are physically connected to each other with the cured synthetic resin layer.

SUMMARY

According to the ink discharge device described in Japanese Patent Application Laid-Open No. 2005-305847, by curing the uncured synthetic resin in a state where it reaches the surface of the actuator unit, it is possible to increase a connection strength between the bump and the terminal. However, when the uncured synthetic resin flows further into a region provided with the drive part after the uncured synthetic resin reaches the surface of the actuator unit, the operation of the drive part is impaired so that there has been a potential for the performance of the actuator unit to be significantly lowered.

It is an object to provide a liquid discharge device and a manufacturing method thereof which are capable of preventing an uncured insulating covering material having reached the surface of a drive unit from flowing into a region provided with a drive part.

A liquid discharge device includes a flow channel unit having a plurality of nozzles for discharging liquid and a plurality of pressure chambers individually communicated with the plurality of individual nozzles, a drive unit having a plurality of drive parts for individually applying a discharge pressure to the liquid in the plurality of pressure chambers and a plurality of electrodes in correspondence to the plurality of drive parts in which a drive voltage is applied to each of the plurality of electrodes to selectively drive the plurality of drive parts, a wiring board having a board main body, a plurality of terminals formed on a surface of the board main body, and an insulating covering material for covering the plurality of terminals, and a plurality of protruding bumps each having conductivity which are disposed on the surface of the drive unit, communicated with the corresponding electrodes, and extended through the insulating covering material to be electrically connected to the corresponding terminals, wherein the insulating covering material is uncured when the plurality of bumps are extended therethrough, and is cured thereafter, and, when a point which is positioned on an outer circumferential surface of a base end portion of one of the bumps, and is closest to one of the drive parts is assumed to be a closest point, and a point which is positioned on the outer circumferential surface of the base end portion of the bump, and is most distant from the drive part is assumed to be a most distant point, a close region including the closest point on the surface of each of the plurality of bumps is processed such that the uncured insulating covering material is less likely to flow in the close region than in a distant region including the most distant point on the surface of each of the plurality of bumps.

In this structure, since the close region including the closest point on the surface of each of the plurality of bumps is processed such that the uncured insulating covering material is less likely to flow in the close region than in the distant region including the most distant point on the surface of each of the plurality of bumps, it follows that more uncured insulating covering material flows into the distant region than into the close region. Accordingly, it is possible to prevent the insulating covering material flowing in the close region from flowing into the region provided with the drive part, and also cause the insulating covering material of the amount sufficient enough to connect the drive unit and the wiring board to each other to reach the surface of the drive unit from the distant region.

It is to be noted that the processing method for rendering the uncured insulating covering material less likely to flow includes a method of forming the surface of the bump into the roughened surface (surface-roughening processing method), and a method of applying a resin material having high water repellency to the surface of the bump (water-repellent treatment method), but the processing method is not limited thereto.

A manufacturing method of a liquid discharge device including a flow channel unit having a plurality of nozzles for discharging liquid and a plurality of pressure chambers individually communicated with the plurality of individual nozzles, a drive unit having a plurality of drive parts for individually applying a discharge pressure to the liquid in the plurality of pressure chambers and a plurality of electrodes communicated with the plurality of drive parts in which a drive voltage is applied to each of the plurality of electrodes to selectively drive the plurality of drive parts, a wiring board having a board main body, a plurality of terminals formed on a surface of the board main body, and an insulating covering material for covering the plurality of terminals, and a plurality of protruding bumps each having conductivity which are disposed on the surface of the drive unit, communicated with the corresponding electrodes, and extended through the insulating covering material to be electrically connected to the corresponding terminals, includes the steps of (a) processing the surface of each of the plurality of bumps such that, when a point which is positioned on an outer circumferential surface of a base end portion of one of the bumps, and is closest to one of the drive parts is assumed to be a closest point, and a point which is positioned on the outer circumferential surface of the base end portion of the bump, and is most distant from the drive part is assumed to be a most distant point, the uncured insulating covering material is less likely to flow in a close region including the closest point on the surface of each of the plurality of bumps than in a distant region including the most distant point on the surface of each of the plurality of bumps, (b) applying the uncured insulating covering material to the surface of the board main body in the wiring board to cover the plurality of terminals, (c) relatively moving the drive unit and the wiring board in a direction in which the drive unit and the wiring board approach each other to cause each of the plurality of bumps to be extended through the insulating covering material and pressed against each of the plurality of terminals, and (d) curing the insulating covering material.

It is possible to prevent the uncured insulating covering material from flowing into the region provided with the drive part, and prevent the performance of the drive unit from being lowered. In addition, since the insulating covering material is more likely to flow in the distant region than in the close region, it is possible to cause the sufficient amount of the insulating covering material to reach the surface of the drive unit from the distant region, and reliably connect the drive unit and the wiring board to each other after the insulating covering material is cured. Further, when the processing is performed such that the uncured insulating covering material is rendered less likely to flow, since it is possible to finely adjust a "degree of the less likelihood to flow", the flow of the uncured insulating covering material can be appropriately controlled in accordance with the material for the bump or the like.

The above and further objects and features will more fully be apparent from the following detailed description with accompanying drawings.

DETAILED DESCRIPTION OF THE EXEMPLARY EMBODIMENTS

A description will be given hereinbelow of a "liquid discharge device" and a "manufacturing method of the liquid discharge device" according to a preferred embodiment with reference to the drawings. In the embodiment shown below, although a description will be given of an "ink discharge device" having a system in which an ink is discharged by using an "actuator unit" as a "drive unit", the "liquid discharge device" may also be other "liquid discharge devices" such as an "ink discharge device" having a system in which the ink is discharged by using a pressure generated when heating is performed using a "heating element unit", a "coloring liquid discharge device" which causes coloring liquid to be discharged, and a "conductive liquid discharge device" which causes conductive liquid to be discharged. When the "coloring liquid discharge device" or the "conductive liquid discharge device" is adopted as the "liquid discharge device", it is assumed that the word "ink" used in the following description is replaced by the words "coloring liquid" or "conductive liquid". In addition, it is assumed that the word "downward" used in the following description denotes a direction in which the ink is discharged, while the word "upward" denotes a direction opposite the direction.

[Overall Structure of Ink Discharge Device]

Figure 1:
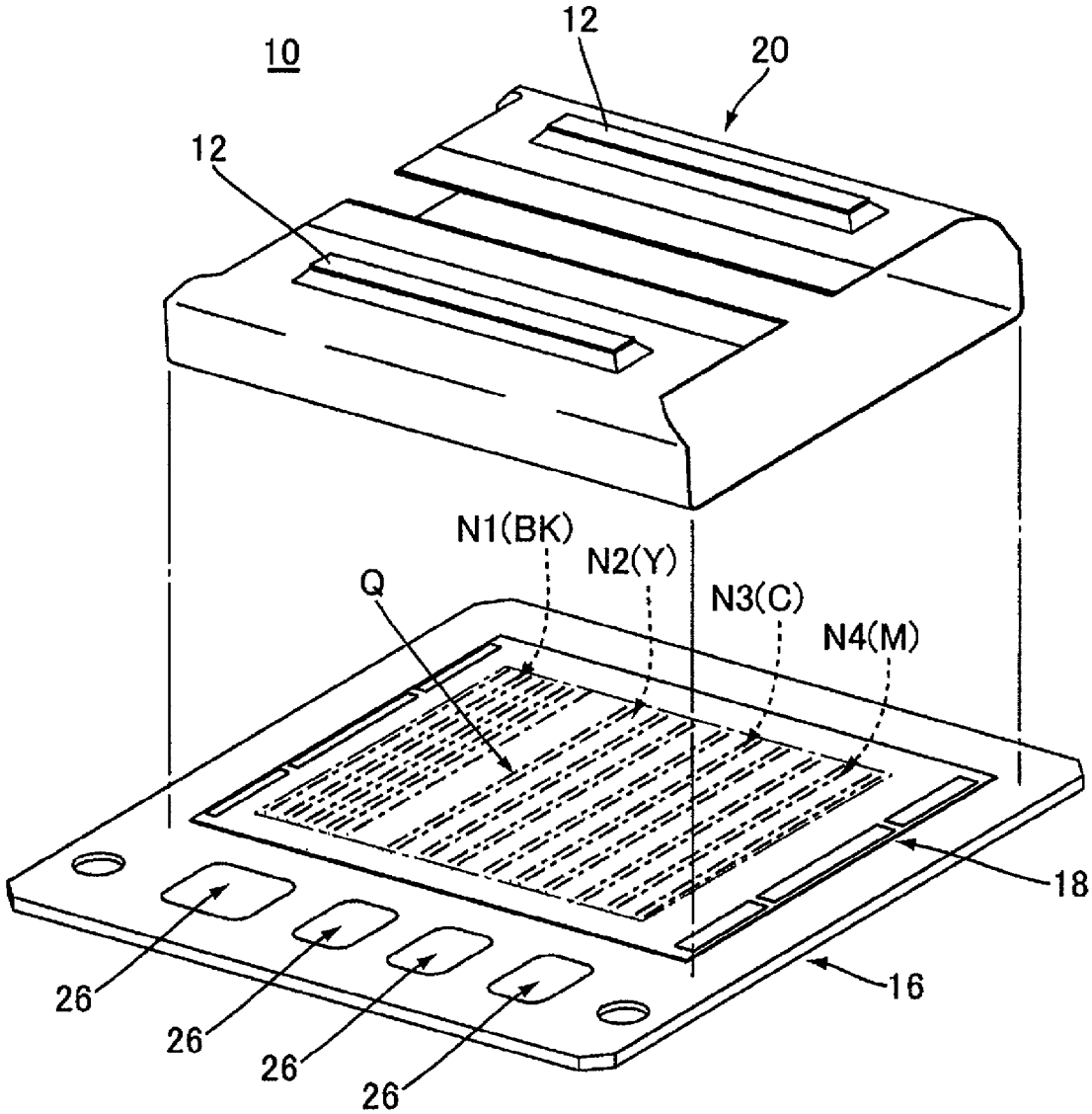
FIG. 1 is an exploded perspective view illustrating a structure of a liquid discharge device according to an embodiment.

FIG. 1 is an exploded perspective view illustrating a structure of an ink discharge device 10. The ink discharge device 10 selectively discharges inks of four colors of black (BK), yellow (Y), cyan (C), and magenta (M) from a plurality of nozzles 14 (FIG. 3) to a discharge target object (the depiction thereof is omitted) such as a paper sheet or the like on the basis of drive voltages generated by two driver ICs 12, and has a flow channel unit 16, an actuator unit 18 as the "drive unit", and a flexible wiring board 20, as illustrated in FIG. 1.

Figure 2:
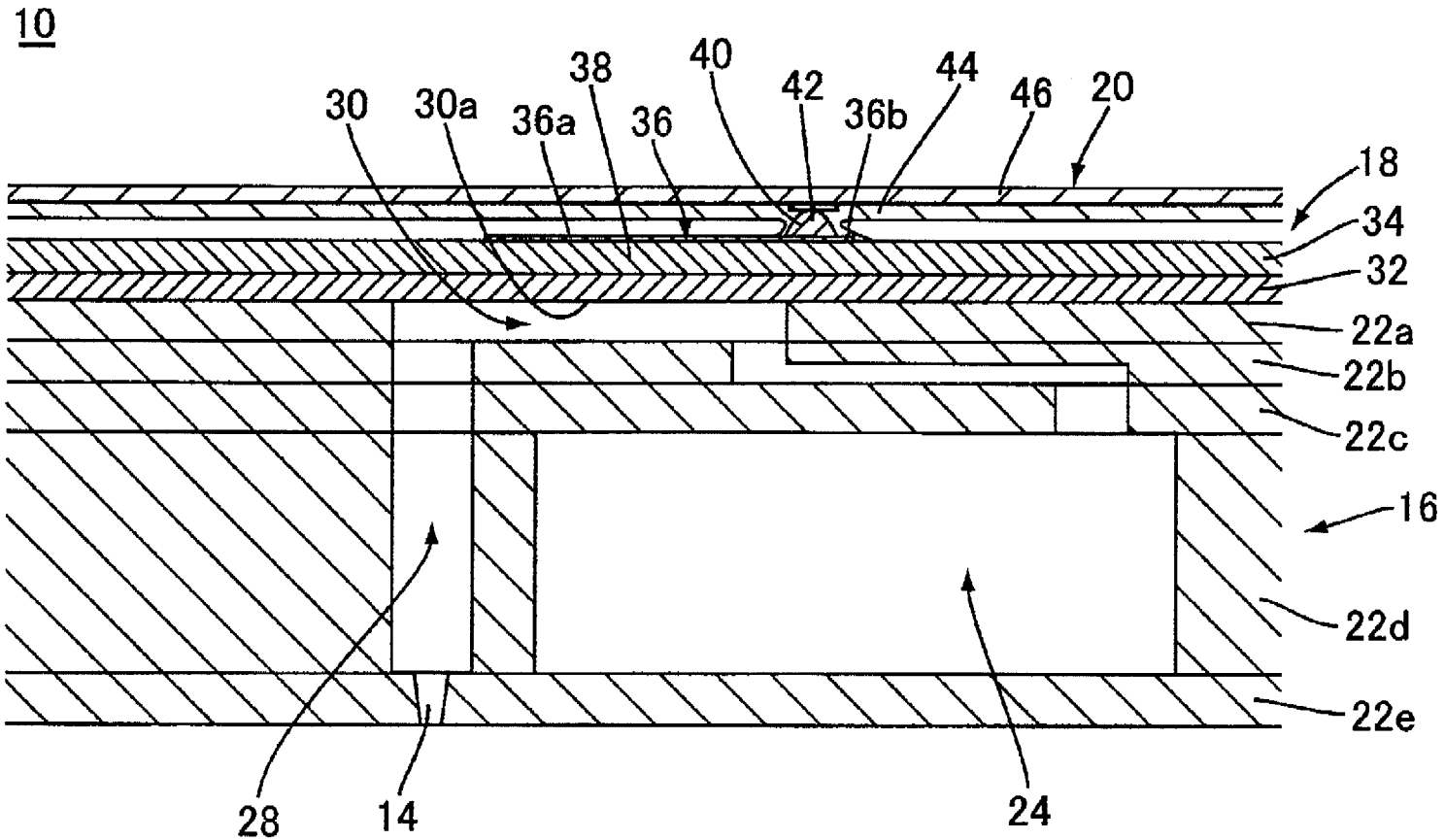
FIG. 2 is a partial cross-sectional view illustrating the structure of the liquid discharge device according to the embodiment.

As illustrated in FIG. 2, the flow channel unit 16 is constituted by laminating five plates 22*a* to 22*e*, and four ink flow channels N1 to N4 (FIG. 1) for the individual colors of the inks are constituted by communicating "concave portions" or "through holes" formed in the plates 22*a* to 22*e* with each other. Specifically, in the flow channel unit 16, a manifold 24 for storing the ink, an ink supply opening 26 (FIG. 1) for supplying the ink to the manifold 24, the plurality of nozzles 14 for discharging the ink in the manifold 24 to the outside, and a plurality of individual flow channels 28 for communicating the manifold 24 and the plurality of nozzles 14 with each other are formed for each of the colors of the inks, and each of the plurality of individual flow channels 28 is provided with a pressure chamber 30 which individually communicates with each of the nozzles 14.

Figure 3:
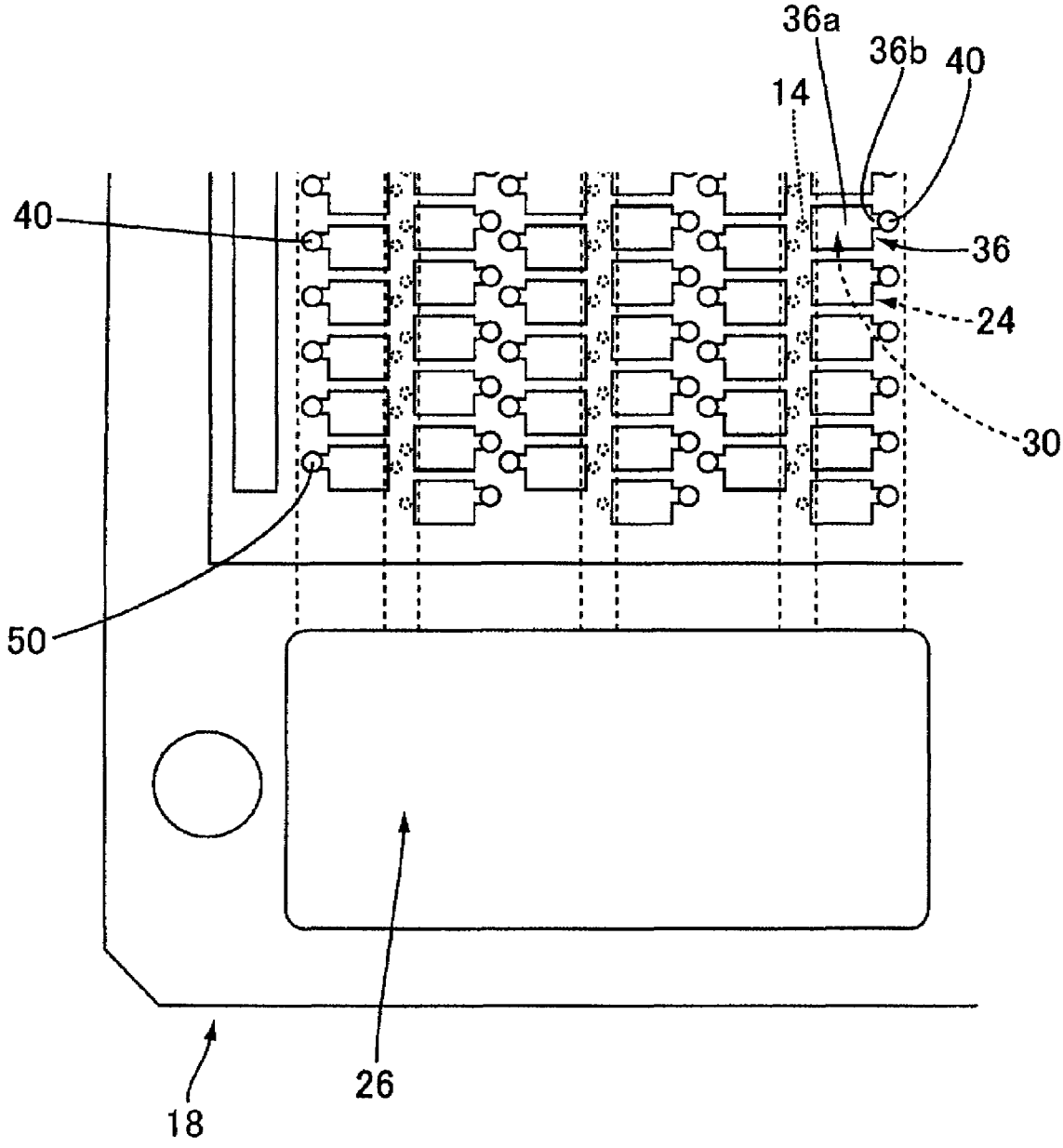
FIG. 3 is a partially enlarged plan view illustrating a structure of a drive unit in the liquid discharge device according to the embodiment.

As illustrated in FIG. 2, the actuator unit 18 constitutes an upper surface 30*a* of the pressure chamber 30 in the flow channel unit 16, selectively applies a discharge pressure to the ink present in the plurality of pressure chambers 30, and has a vibration plate 32, a piezoelectric layer 34, and a plurality of electrodes 36. The vibration plate 32 is composed of a conductive material, and is bonded to the upper surface of the flow channel unit 16 so as to cover the plurality of pressure chambers 30. The piezoelectric layer 34 is composed of a piezoelectric material containing lead zirconium titanate (PZT) as the main component, and is polarized in a direction of its thickness. Each of the plurality of electrodes 36 is composed of the conductive material, and has an electrode part 36*a* disposed at a position opposing the pressure chamber 30 on the surface of the actuator unit 18, and a terminal part 36*b* disposed at a position off the position, as illustrated in FIG. 3. Accordingly, in the actuator unit 18, the part in the piezoelectric layer 34 which is sandwiched between the vibration plate 32 and the electrode part 36*a* serves as a drive part 38 which is driven by a drive voltage, as illustrated in FIG. 2. In addition, on the surface of the terminal part 36*b* in the electrode 36, a bump 40 (FIGS. 6A to 6C) which will be described later is formed. It is to be noted that the electrode part 36*a* and the terminal part 36*b* are examples included in an "electrode" in the claims.

Figure 4:
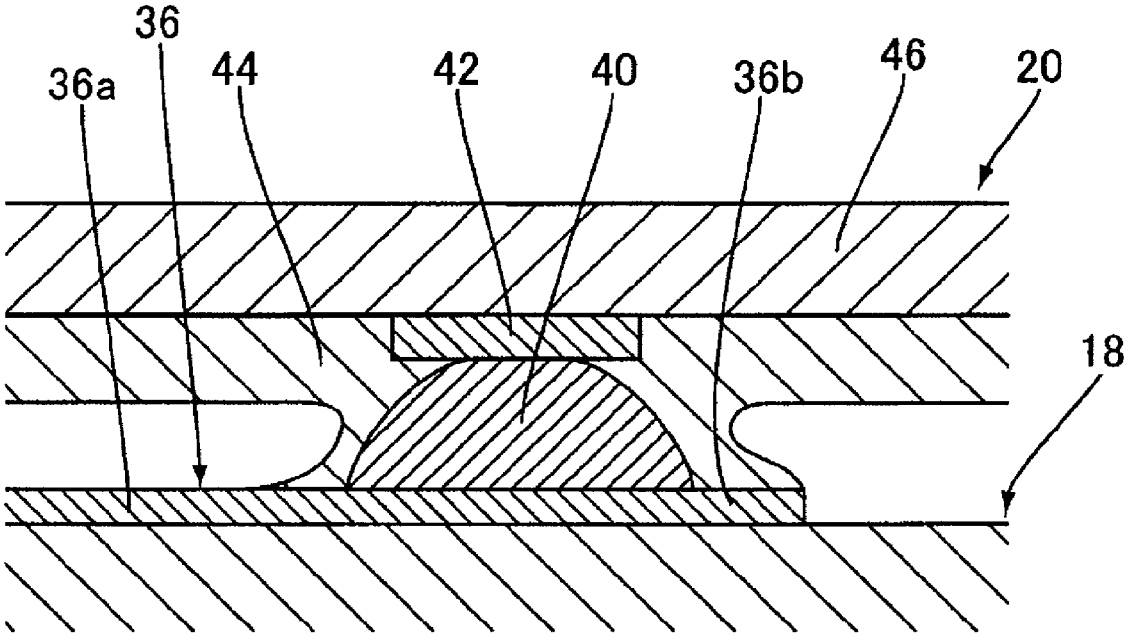
FIG. 4 is a partially enlarged cross-sectional view illustrating a structure of the principal portion of the liquid discharge device according to the embodiment.
Figure 5:
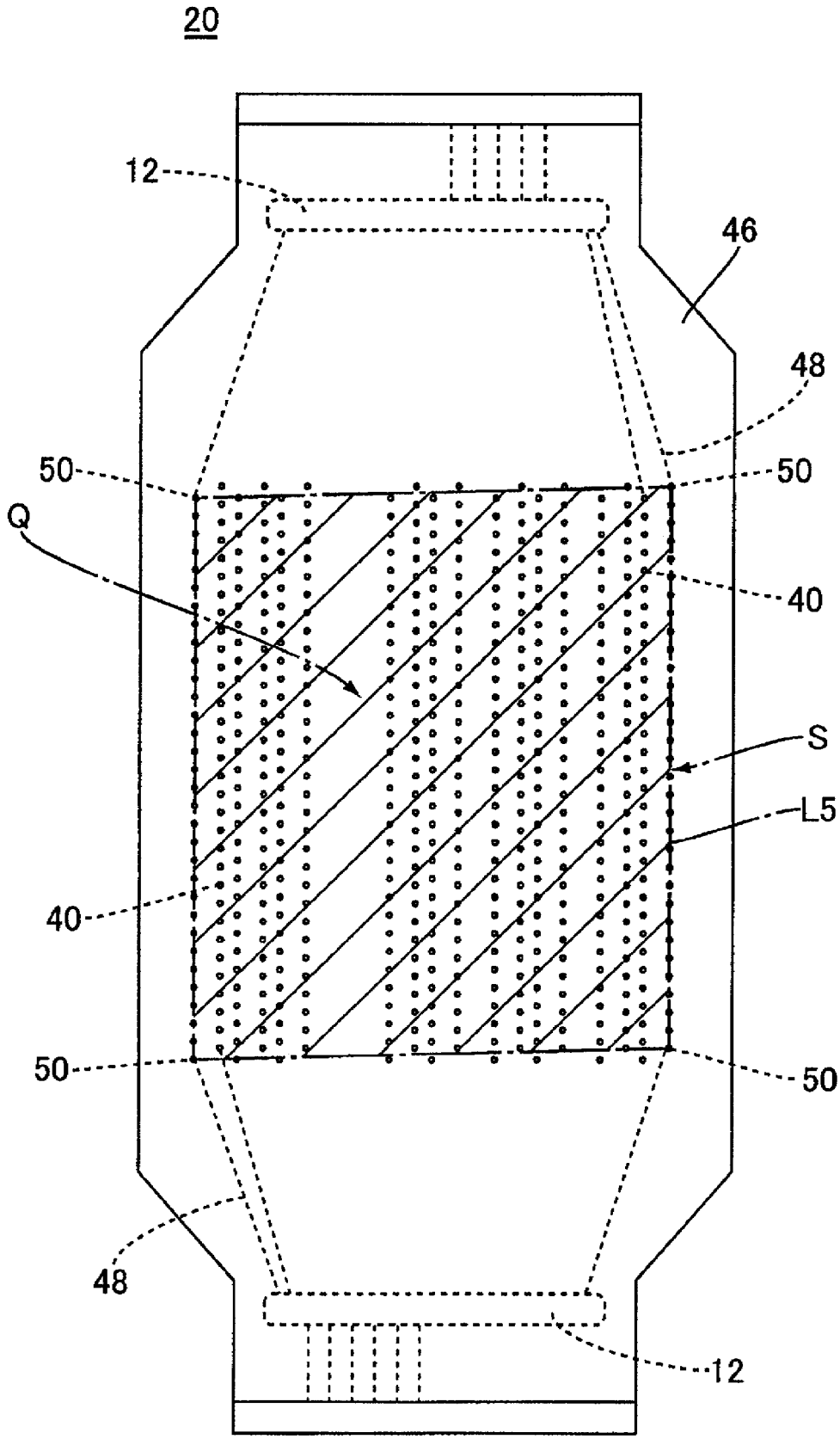
FIG. 5 is a plan view illustrating a structure of a wiring board in the liquid discharge device according to the embodiment.

The wiring board 20 is what is called a "COF (Chip On Film)" and, as illustrated in FIGS. 4 and 5, the wiring board 20 has a sheet-like board main body 46 composed of a synthetic resin material having flexibility such as a polyimide resin or the like, a plurality of terminals 42 formed on one surface of the board main body 46 by using the conductive material such as a copper foil or the like, the two driver ICs 12 (FIGS. 1 and 5) mounted on the one surface of the board main body 46, a plurality of wirings 48 (FIG. 5) which are formed on the one surface of the board main body 46 by using the conductive material such as the copper foil or the like, and electrically connect each of the plurality of terminals 42 and either one of the two driver ICs 12 to each other, and an insulating covering material 44 (FIG. 4) which covers the plurality of terminals 42 and the plurality of wirings 48 on the one surface of the board main body 46. Further, the drive voltage generated in each of the two driver ICs 12 is applied to the actuator unit 18 through the plurality of wirings 48 and the plurality of terminals 42.

[Connection Structure of Wiring Board]

In the present embodiment, since there is constituted a "connection structure of the wiring board" in which the actuator unit 18 and the wiring board 20 are connected to each other using the insulating covering material 44, the bumps 40, and the terminals 42, a description will be given hereinbelow of the components in greater detail.

<Insulating Covering Material>

The insulating covering material 44 is uncured when the plurality of bumps are extended therethrough during the manufacturing process and is cured thereafter, and is composed of the synthetic resin material (the epoxy resin or the like) having thermosetting properties and electrical insulating properties. In addition, a thickness of the insulating covering material 44 is designed to be about 15 to 20 μm so as to be able to simultaneously exert an "electrical insulation function" with respect to the terminals 42 and the wirings 48, and a "connection function" of connecting the actuator unit 18 and the wiring board 20 to each other.

It is to be noted that the material for the insulating covering material 44 may be any material which remains uncured when the actuator unit 18 and the wiring board 20 are connected to each other (in other words, when the plurality of bumps 40 are extended therethrough) and becomes cured thereafter, and an "ultraviolet-curing resin" which is cured by ultraviolet light or the like may also be used instead of the "thermosetting resin" which is cured by heat as in the present embodiment.

<Bump>

Figure 6A:
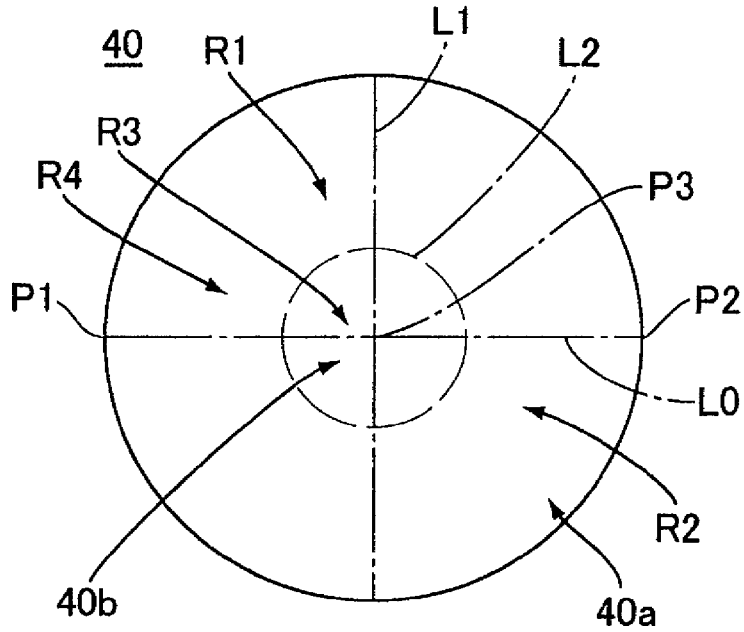
FIG. 6A is a plan view illustrating a structure of a bump in the liquid discharge device according to the embodiment.
Figure 6B:
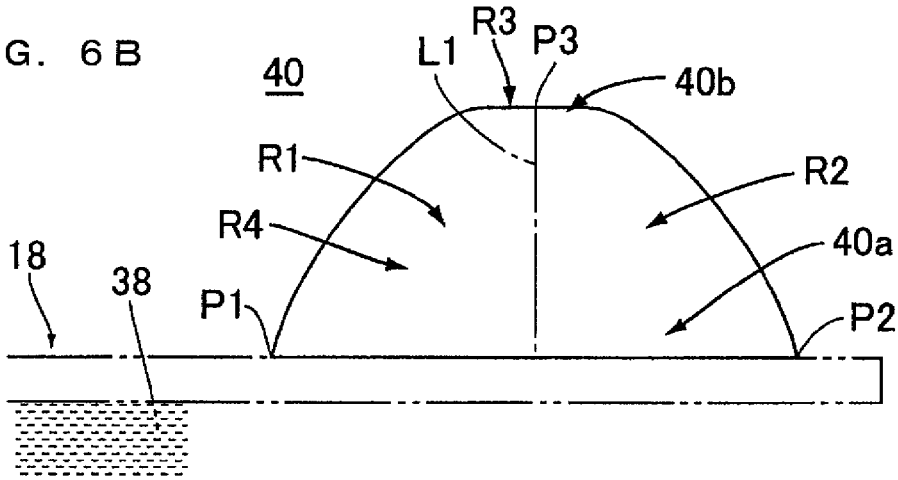
FIG. 6B is an front view illustrating the structure of the bump in the liquid discharge device according to the embodiment.
Figure 6C:
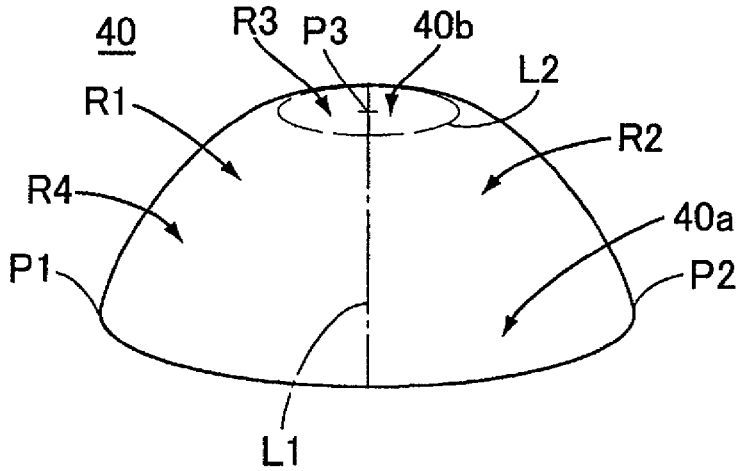
FIG. 6C is a perspective view illustrating the structure of the bump in the liquid discharge device according to the embodiment.

As illustrated in FIGS. 6A to 6C, each of the plurality of bumps 40 is a protruding member which is formed into a generally circular truncated conical shape or a generally hemispherical shape with the conductive material (a metal material containing Ag or the like), and the surface of the bump 40 is formed into a tilted surface which becomes outwardly wider from a top portion 40*b* toward a base end portion 40*a*. In addition, as illustrated in FIG. 4, the base end portion 40*a* of the bump 40 is disposed on the surface of the actuator unit 18 via the terminal part 36*b*, and is also communicated with the corresponding electrode 36 (the electrode part 36*a*), while with the corresponding electrode 36 (the electrode part 36*a*), while the top portion 40*b* of the bump 40 is extended through the insulating covering material 44 to be pressed against the corresponding terminal 42, whereby the electrode 36, the bump 40, and the terminal 42 are electrically connected to each other. In contrast to the thickness of the insulating covering material 44 of about 15 to 20 μm, a height of the bump 40 is designed to be about 35 μm. Accordingly, during the manufacturing of the ink discharge device 10, as will be described later, the uncured insulating covering material 44 which has been pushed away by the top portion 40*b* of the bump 40 flows on the respective surfaces of the terminal 42 and the bump 40 to reach the surface of the actuator unit 18, and exerts the above-described "connection function" after being cured.

When the insulating covering material 44 having reached the surface of the actuator unit 18 flows further on the surface to reach the region provided with the drive part 38, the operation of the drive part 18 is impaired so that there is a potential for the performance of the actuator unit 18 to be significantly lowered. On the other hand, when the flow of the insulating covering material 44 is completely stopped on the surface of the bump 40, since it is not possible to cause the insulating covering material 44 to adhere to a region across the actuator unit 18 and the wiring board 20, the "connection function" of the insulating covering material 44 can not be effectively exerted so that there is a potential for the connection strength between the actuator unit 18 and the wiring board 20 to be significantly reduced. Further, when the top portion 40*b* of the bump 40 is pressed against the terminal 42 (FIG. 4), in a case where an oxide insulating film (the depiction thereof is omitted) present on the surface of the terminal 42 is interposed therebetween, the terminal 42 and the bump 40 can not be electrically connected to each other adequately. Consequently, in the present embodiment, a structure is adopted in which an appropriate amount of the insulating covering material 44 reaches the surface of the actuator unit 18 by adjusting the surface roughness of the bump 40, and the terminal 42 and the bump 40 are thereby electrically connected to each other reliably.

Specifically, as illustrated in FIGS. 6A to 6C, when a point which is positioned on an outer circumferential surface of the base end portion 40*a* of the bump 40, and is closest to the drive part 38 is assumed to be a closest point P1, and a point which is positioned on the outer circumferential surface of the base end portion 40*a*, and is most distant from the drive part 38 is assumed to be a most distant point P2, a close region R1 including the closest point P1 on the surface of each of the plurality of bumps 40 is formed such that the uncured insulating covering material 44 is less likely to flow in the close region R1 than in a distant region R2 including the most distant point P2 on the surface of each of the plurality of bumps 40. That is, the surface roughness of the close region R1 is designed to be higher than that of the distant region R2 such that a contact resistance of the close region R1 to the uncured insulating covering material 44 is larger than that of the distant region R2. Accordingly, it is possible to prevent the uncured insulating covering material 44 which has been pushed away by the top portion 40*b* of the bump 40 from flowing into the region provided with the drive part 38 on the surface of the actuator unit 18 through the close region R1, and is also possible to cause the sufficient amount of the insulating covering material 44 to reach the surface of the actuator unit 18 through the distant region R2 so that the actuator unit 18 and the wiring board 20 can be reliably connected to each other after the insulating covering material 44 is cured.

In addition, as illustrated in FIGS. 6A to 6C, when a point on the bump 40 which is firstly pressed against the terminal 42 is assumed to be a contact point P3, a surface of a contact region R3 which includes the contact point P3 on the surface of the bump 40, and does not overlap the close region R1 or the distant region R2 is formed to be rougher than that of a surrounding region R4 (in the present embodiment, the surrounding region R4 overlaps the close region R1 and the distant region R2) which surrounds the contact region R3 on the surface of the bump 40. In the present embodiment, since the surrounding region R4 overlaps the above-described close region R1 and distant region R2, and the contact region R3 does not overlap the close region R1 or the distant region R2, the contact region R3 has the surface rougher than those of the close region R1 and the distant region R2 and, in the order of the contact region R3, the close region R1, and the distant region R2 (R3>R1>R2), their respective surface roughnesses are made to be higher. Accordingly, when the top portion 40*b* of the bump 40 is pressed against the terminal (FIG. 4), the contact region R3 formed to be the roughest is capable of breaking the oxide insulating film formed on the surface of the terminal 42, and an electrical connection state between the terminal 42 and the bump 40 is reliably and stably obtainable.

It is to be noted that a "boundary between the close region R1 and the distant region R2" or a "boundary between the contact region R3 and the surrounding region R4" is not particularly limited. However, in the present embodiment, as illustrated in FIG. 6A, when the bump 40 is two-dimensionally viewed, a line extending in a direction orthogonal to a virtual line L0 joining the closest point P1 and the most distant point P2 serves as a boundary line L1 for separating the close region R1 from the distant region R2, and the surface area of the bump 40 is halved by the boundary line L1. Further, as illustrated in FIGS. 6B and 6C, when the bump 40 is viewed from the front, a line which defines a circle obtained by joining points where the curvature of the tilted surface is sharply changed serves as a boundary line L2 for separating the contact region R3 from the surrounding region R4.

It is to be noted that, as the method for forming the surface of the bump 40 into a roughened surface, it is possible to use arbitrary methods which have been conventionally used. For example, it is possible to use a "method in which ions are sprayed onto a surface of the bump 40 to roughen the surface (ion spray method)", and a "method in which a granular material which is melted by etching is preliminarily mixed in the bump 40, and the granular material is melted by etching processing performed afterward to obtain the roughened surface (etching method)".

In addition, as the method for rendering the uncured insulating covering material 44 less likely to flow, instead of the "method for forming the surface of the bump 40 into the roughened surface (the surface-roughening processing method)" of the present embodiment, there may be used a "method in which a fluorine-based resin or the like is applied onto a part of the surface of the bump 40 to adjust likelihood to flow on the surface to which the resin is applied and that on the surface without the resin (the water-repellent treatment method)" or the like.

Further, in the present embodiment, although the "likelihood to flow" of the uncured insulating covering material 44 is adjusted by changing a "degree of the surface roughness" in each of the regions to which the surface-roughening processing is performed, the "likelihood to flow" may be adjusted by changing a "direction of projections and depressions which constitute the roughened surface", or changing both of the "degree of the surface roughness" and the "direction of projections and depressions which constitute the roughened surface". For example, in the close region R1, by designing the direction of projections and depressions so as to protrude toward the upstream side of the flow of the insulating covering material 44, the contact resistance to the uncured insulating covering material 44 is increased, and the insulating covering material 44 may be thereby rendered less likely to flow.

<Terminal>

Figure 7:
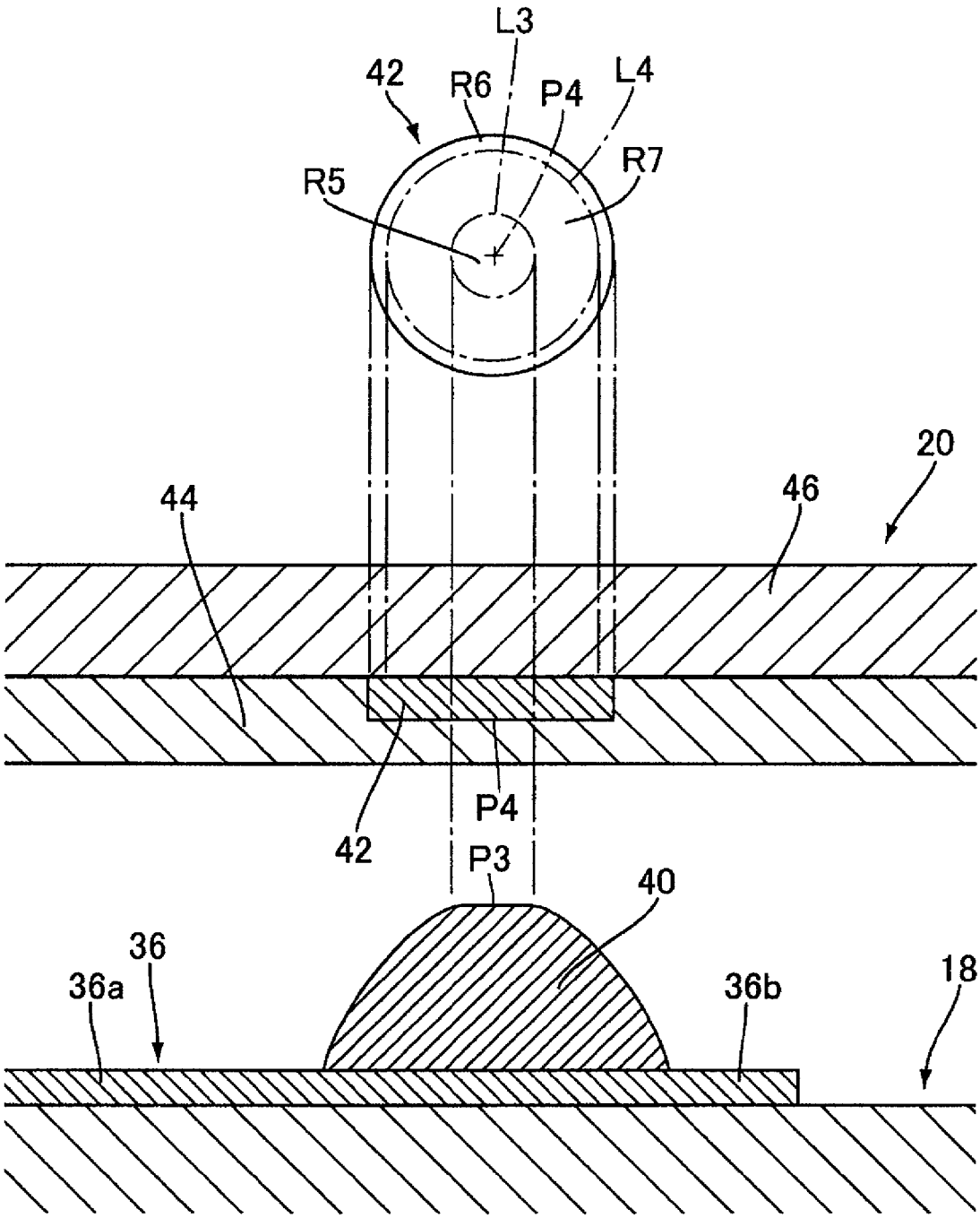
FIG. 7 is a view illustrating a structure of a terminal in the liquid discharge device according to the embodiment.

As illustrated in FIG. 7, each of the plurality of terminals 42 is formed to be substantially circular in opposing relation to each of the plurality of terminal parts 36*b* in the actuator unit 18, and a contacted point P4 which is in contact with the contact point P3 of the bump 40 is positioned at the central part of the terminal 42. Additionally, in the terminal 42, a circular region including the contacted point P4 serves as a pressed region R5 against which the bump 40 is pressed, an annular region constituting the outer circumferential portion of the terminal 42 serves as a terminal surrounding region R6 which is positioned around the pressed region R5, and an annular region which is positioned between an outer circumferential edge L3 of the pressed region R5 and an inner circumferential edge L4 of the terminal surrounding region R6 serves as an intermediate region R7.

When the bump 40 which has been extended through the uncured insulating covering material 44 is pressed against the terminal 42, the insulating covering material 44 which has covered the terminal 42 is pushed away by the bump 40, and is moved toward the terminal surrounding region R6 from the pressed region R5 through the intermediate region R7. However, only with the movement of the insulating covering material 44 in a direction in parallel to the surface of the terminal 42, it is not possible to cause the insulating covering material 44 to reach the surface of the actuator unit 18 and, therefore, the "connection function" of the insulating covering material 44 can not be effectively exerted. Consequently, in the present embodiment, a structure is adopted in which, by adjusting the respective surface roughnesses of the pressed region R5, the terminal surrounding region R6, and the intermediate region R7, the adequate amount of the insulating covering material 44 reaches the surface of the actuator unit 18. That is, as illustrated in FIG. 7, the surface roughnesses of the individual regions of the terminal 42 are designed to be higher in the order of the terminal surrounding region R6, the pressed region R5, and the intermediate region R7 (R6>R5>R7).

Accordingly, during the manufacturing process, the uncured insulating covering material 44, which has been pushed away from the pressed region R5 by the top portion 40*b* of the bump 40, smoothly flows in the intermediate region R7, but the uncured insulating covering material 44 is rendered less likely to flow from the intermediate region R7 toward the terminal surrounding region R6 so that it follows that the insulating covering material 44 is guided from the intermediate region R7 to the surrounding region R4 (the close region R1 and the distant region R2) of the bump 40. Subsequently, it follows that more insulating covering material 44 having reached the surrounding region R4 flows into the distant region R2 than into the close region R1 and, as described above, the adequate amount of the insulating covering material 44 reaches the surface of the actuator unit 18. Moreover, since the surface roughness of the pressed region R5 is higher than that of the intermediate region R7, a "clinging property" of the insulating covering material 44 to the pressed region R5, i.e., a "bonding property caused by biting into the roughened surface" is improved, and the insulating covering material 44 is allowed to remain around the bump 40 bonded to the pressed region R5 so that it is possible to reliably perform the physical and electrical connection of the bump 40 to the terminal 42.

It is to be noted that it is desired to design the respective surface roughnesses of the pressed region R5, the terminal surrounding region R6, and the intermediate region R7 each in the terminal 42, and the respective surface roughnesses of the close region R1 and the distant region R2 each in the bump 40 in association with each other in order to cause the adequate amount of the insulating covering material 44 to reach the surface of the actuator unit 18 and, in order to efficiently guide the insulating covering material 44 having pushed out of the pressed region R5 to the close region R1 and to the distant region R2 from the intermediate region R7, it is also desirable that the surface roughnesses of the individual regions be made to be higher in the order of the terminal surrounding region R6, the close region R1, the distant region R2, the pressed region R5, and the intermediate region R7 (R6>R1>R2>R5>R7).

<Connection Bump>

In the present embodiment, as illustrated in FIGS. 1 and 2, since the plurality of nozzles 14 constituting the individual ink flow channels N1 to N4 are disposed to form a plurality of nozzle lines, the plurality of electrodes 36 in correspondence to the plurality of individual nozzles 14 are disposed to form a plurality of electrode lines on the surface of the actuator unit 18, and the plurality of bumps 40 are correspondingly disposed to form a plurality of bump lines. Consequently, when the ink discharge device 10 is two-dimensionally viewed, as illustrated in FIG. 5, the plurality of individual bumps 40 are disposed in a substantially rectangular bump region Q on the surface of the actuator unit 18.

After the actuator unit 18 and the wiring board 20 are bonded together using the insulating covering material 44, when an external force is applied to the wiring board 20 in a direction in which the wiring board 20 is torn off the actuator unit 18, the external force intensively operates on at least one of four bumps positioned at four corner portions of the bump region Q. Consequently, the wiring board 20 is easily torn off when the connection strength with the insulating covering material 44 is not sufficient at the four bumps, which is a serious cause for the occurrence of a defective piece. Accordingly, in the present embodiment, at least on each of the four corner portions of the bump region Q, a connection bump 50 for increasing the connection strength between the actuator 18 and the wiring board 20 is disposed.

Figure 8:
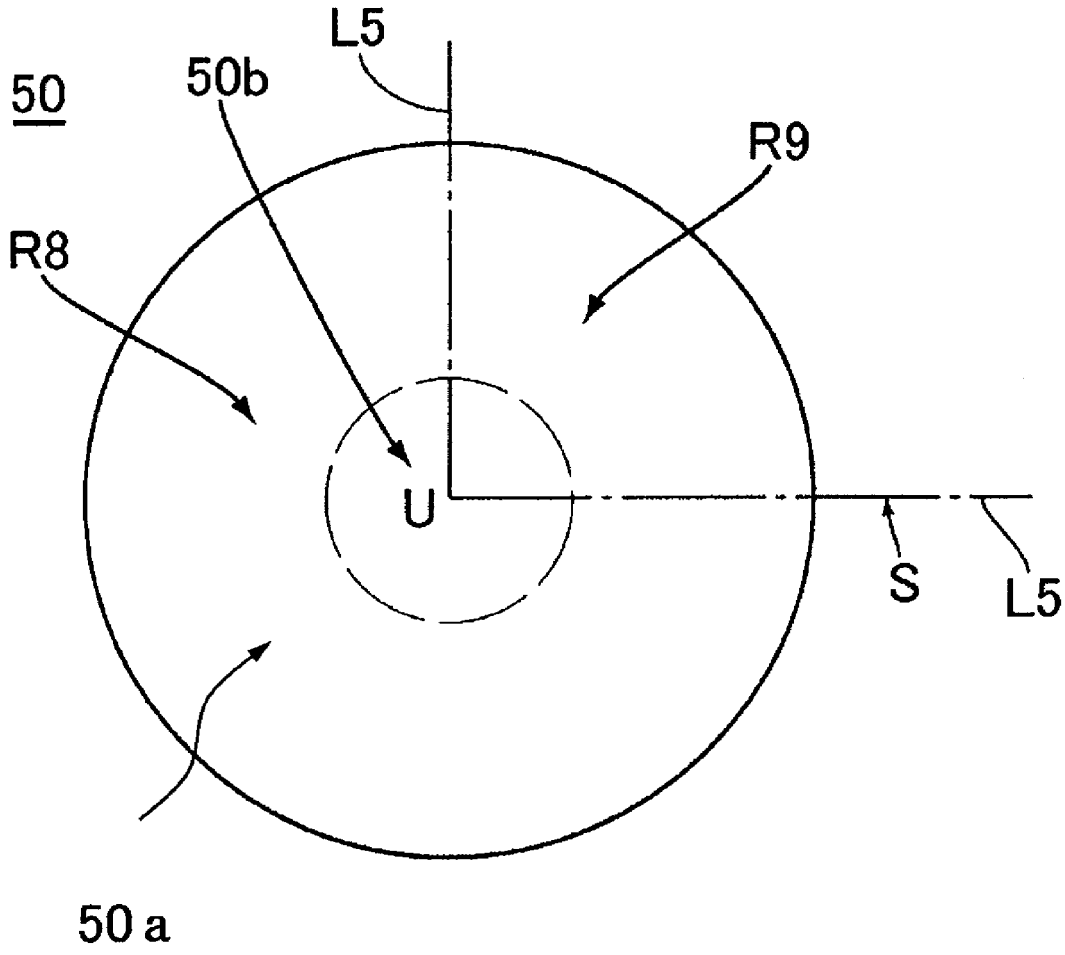
FIG. 8 is a plan view illustrating a structure of a connection bump in the liquid discharge device according to the embodiment.

Each of the plurality of connection bumps 50 is formed similarly to the above-described bump 40 except for the surface condition (the surface roughness or the like). Specifically, the surface of the connection bump 50 is formed into a tilted surface which becomes outwardly wider from a top portion 50*b* toward a base end portion 50*a*. Additionally, as illustrated in FIGS. 5 and 8, when there is assumed a reference rectangle S obtained by joining central points U (FIG. 8) of the four connection bumps 50 disposed at the individual four corner portions of the bump region Q by a virtual line L5, at least part of an outside region R8 positioned outside the reference rectangle S on the surface of each of the connection bumps 50 is formed to be rougher than an inside region R9 positioned inside the reference rectangle S. Accordingly, in at least part of the outside region R8, biting to the insulating covering material 44 is improved so that the connection strength between the connection bump 50 and the insulating covering material 44 is increased, and the connection strength between the actuator 18 and the wiring board 20 is thereby increased.

[Manufacturing Method of Ink Discharge Device]

A manufacturing method of the ink discharge device 10 is executed by a "component manufacturing step" of manufacturing the flow channel unit 16, the actuator unit 18, and the wiring board 20, a "first bonding step" of bonding the flow channel unit 16 and the actuator unit 18 together, and a "second bonding step" of bonding the actuator unit 18 and the wiring board 20 together.

In the "component manufacturing step", the flow channel unit 16, the actuator unit 18, and the wiring board 20 are separately manufactured. In the manufacturing step of the actuator unit 18, the above-described surface-roughening processing (FIGS. 6A to 6C, FIG. 8) is performed with respect to the respective surfaces of the plurality of bumps 40 and the plurality of connection bumps 50, while in the manufacturing step of the wiring board 20, the above-described surface-roughening processing (FIG. 7) is performed with respect to the respective surfaces of the plurality of terminals 42. It is to be noted that, as the specific method of the surface-roughening processing, it is possible to use the "ion spray method" and the "etching method", and the "chemical treatment method" instead of the "surface-roughening processing method", as described above.

In the "first bonding step", the flow channel unit 16 and the actuator unit 18 are mutually positioned, and are bonded together using an adhesive or the like. It is to be noted that the surface-roughening processing with respect to the respective surfaces of the plurality of bumps 40 and the plurality of connection bumps 50 may also be performed after the flow channel unit 16 and the actuator unit 18 are bonded together in the "first bonding step".

In the "second bonding step", the uncured insulating covering material 44 is firstly applied onto the surface of the board main body 46 in the wiring board 20, and the plurality of terminals 42 and the plurality of wirings 48 (FIG. 5) to which the surface-roughening processing has already been performed are covered with the insulating covering material 44. Subsequently, by relatively moving the actuator unit 18 and the wiring board 20 in a direction in which they approach each other, the respective top portions 40*b* and 50*b* of the plurality of bumps 40 and the plurality of connection bumps 50 are caused to be extended through the insulating covering material 44 and pressed against the plurality of terminals 42. Thereafter, the uncured insulating covering material 44 is heated (e.g., 150° C.), and the insulating covering material 44 is thereby cured.

It is to be noted that the step of curing the insulating covering material 44 in the "second bonding step" differs depending on the type of the insulating covering material 44, and the insulating covering material 44 is irradiated with ultraviolet light when the ultraviolet-curing resin is used as the insulating covering material 44.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A liquid discharge device, comprising:

a flow channel unit having a plurality of nozzles for discharging liquid and a plurality of pressure chambers individually communicated with the plurality of individual nozzles;

a drive unit having a plurality of drive parts for individually applying a discharge pressure to the liquid in the plurality of pressure chambers and a plurality of electrodes in correspondence to the plurality of drive parts in which a drive voltage is applied to each of the plurality of electrodes to selectively drive the plurality of drive parts;

a wiring board having a board main body, a plurality of terminals formed on a surface of the board main body, and an insulating covering material for covering the plurality of terminals; and a plurality of protruding bumps each having conductivity which are disposed on the surface of the drive unit, communicated with the corresponding electrodes, and extended through the insulating covering material to be electrically connected to the corresponding terminals;

wherein the insulating covering material is uncured when the plurality of bumps are extended therethrough, and is cured thereafter, and when a point which is positioned on an outer circumferential surface of a base end portion of one of the bumps, and is closest to one of the drive parts is assumed to be a closest point, and a point which is positioned on the outer circumferential surface of the base end portion of the bump, and is most distant from the drive part is assumed to be a most distant point, a close region including the closest point on the surface of each of the plurality of bumps is processed such that the uncured insulating covering material is less likely to flow in the close region than in a distant region including the most distant point on the surface of each of the plurality of bumps.

2. The liquid discharge device of claim 1, wherein when a point which is firstly pressed against one of the terminals in the bump is assumed to be a contact point, a contact region which includes the contact point on the surface of each of the plurality of bumps, and does not overlap the close region or the distant region is formed to be rougher than a surrounding region surrounding the contact region on the surface of each of the plurality of bumps.

3. The liquid discharge device of claim 2, wherein when a point in contact with the contact point on the surface of the terminal is assumed to be a contacted point, a region including the contacted point on the surface of the terminal is assumed to be a pressed region, and a region positioned around the pressed region on the surface of the terminal is assumed to be a terminal surrounding region, the terminal surrounding region is formed to be rougher than the pressed region.

4. The liquid discharge device of claim 3, wherein when a region positioned between an outer circumferential edge of the pressed region and an inner circumferential edge of the terminal surrounding region each on the surface of the terminal is assumed to be an intermediate region, the pressed region is formed to be rougher than the intermediate region.

5. The liquid discharge device of claim 4, wherein surface roughnesses of the individual regions are made to be higher in an order of the terminal surrounding region, the close region, the distant region, the pressed region, and the intermediate region.

6. The liquid discharge device of claim 1, wherein each of the plurality of bumps is disposed in a substantially rectangular bump region on the surface of the drive unit, at least each of four corner portions of the bump region is provided with a connection bump for increasing a connection strength between the drive unit and the wiring board, and when there is assumed a reference rectangle obtained by joining central points of the four connection bumps disposed at the individual four corner portions by a line, at least part of an outside region positioned outside the reference rectangle on the surface of each of the four bumps is formed to be rougher than an inside region positioned inside the reference rectangle.

7. The liquid discharge device of claim 1, wherein a degree of surface roughness of the close region is different from that of the distant region.

8. The liquid discharge device of claim 1, wherein a direction of projections and depressions which constitute a roughened surface of the close region is different from that of the distant region.

9. A manufacturing method of a liquid discharge device comprising a flow channel unit having a plurality of nozzles for discharging liquid and a plurality of pressure chambers individually communicated with the plurality of individual nozzles, a drive unit having a plurality of drive parts for individually applying a discharge pressure to the liquid in the plurality of pressure chambers and a plurality of electrodes communicated with the plurality of drive parts in which a drive voltage is applied to each of the plurality of electrodes to selectively drive the plurality of drive parts, a wiring board having a board main body, a plurality of terminals formed on a surface of the board main body, and an insulating covering material for covering the plurality of terminals, and a plurality of protruding bumps each having conductivity which are disposed on the surface of the drive unit, communicated with the corresponding electrodes, and extended through the insulating covering material to be electrically connected to the corresponding terminals, comprising the steps of:

processing the surface of each of the plurality of bumps such that, when a point which is positioned on an outer circumferential surface of a base end portion of one of the bumps, and is closest to one of the drive parts is assumed to be a closest point, and a point which is positioned on the outer circumferential surface of the base end portion of the bump, and is most distant from the drive part is assumed to be a most distant point, the uncured insulating covering material is less likely to flow in a close region including the closest point on the surface of each of the plurality of bumps than in a distant region including the most distant point on the surface of each of the plurality of bumps;

applying the uncured insulating covering material to the surface of the board main body in the wiring board to cover the plurality of terminals;

relatively moving the drive unit and the wiring board in a direction in which the drive unit and the wiring board approach each other to cause each of the plurality of bumps to be extended through the insulating covering material and pressed against each of the plurality of terminals; and curing the insulating covering material.

* * * * *